US006150943A

United States Patent [19]

Lehman et al.

[11] Patent Number: 6,150,943

[45] Date of Patent: Nov. 21, 2000

[54] LASER DIRECTOR FOR FIRE EVACUATION PATH

[75] Inventors: Mark R. Lehman, Palos Verdes Estates; Dan Gechtman, Sherman Oaks; Jerome Keith Fuller, Van Nuys; Michael A. Hreha, Oceanside, all of Calif.

[73] Assignee: American Xtal Technology, Inc., Fremont, Calif.

[21] Appl. No.: 09/353,162

[22] Filed: Jul. 14, 1999

[51] Int. Cl.[7] ..... G08B 17/10

[52] U.S. Cl. ..... 340/628; 340/332; 340/691.1; 362/259

[58] Field of Search ..... 340/628, 632, 340/691.1, 326, 331, 332; 362/259

[56] References Cited

U.S. PATENT DOCUMENTS

| | | | |
|---|---|---|---|
| 3,603,662 | 9/1971 | Wuerker . | |
| 3,969,720 | 7/1976 | Nishino . | |
| 4,084,339 | 4/1978 | Peltier . | |
| 4,801,928 | 1/1989 | Minter | 340/691 |
| 4,904,988 | 2/1990 | Nesbit et al. | 340/628 |
| 5,140,301 | 8/1992 | Watanabe . | |
| 5,177,461 | 1/1993 | Budzyna . | |
| 5,572,183 | 11/1996 | Sweeney | 340/332 |
| 5,920,268 | 7/1999 | Bucci et al. | 340/825.31 |

*Primary Examiner*—Julie Lieu
*Attorney, Agent, or Firm*—Howard Cohen

[57] ABSTRACT

A device for projecting an escape path to direct evacuation from a fire includes a plurality of laser diode projectors secured within a housing and aimed to project successive rays or images along a predetermined escape path. The images may comprise arrow indicators, graphics, or alphanumeric indicators. The laser beams are emitted through the same window in the housing to minimize heat infiltration into the housing. The laser diodes are triggered by an alarm condition, such as direct actuation by a smoke sensor, IR detector, or the like, or secondary actuation in response to the audio alarm signal of a primary fire alarm. For actuation by a primary alarm system, a microphone input is amplified and fed to a microprocessor. The microprocessor is programmed to digitally filter and process the signal to determine the presence of a primary alarm signal, and actuate a fire escape path illuminating module. The audio pickup includes a pair of microphones spaced apart approximately one-half wavelength of the primary alarm signal to avoid acoustic standing wave problems, the microphones switching periodically to acquire the best signal. The microprocessor operates in a low power mode, and activates only when the microphone signal exceeds a predetermined level. A housing for the system is mounted in the opposed arms of a C-shaped bracket, so that the housing may rotate (yaw) through a large angle and tilt (pitch) through an angular range to orient the projection of the fire escape path indicators.

35 Claims, 13 Drawing Sheets

LASER DIRECTOR FOR FIRE EVACUATION PATH

BACKGROUND OF THE INVENTION

This invention relates to fire alarm systems, and, more particularly, to fire alarm systems that provide guidance for building dwellers to flee a building that is burning.

Fire alarms are generally triggered by manual emergency switches, heat sensors, or smoke sensors. Upon being alerted by a fire alarm, the occupants of a building must instantaneously take stock of their situations and decide if they should flee the building, and then what path they should take to evacuate. Although many persons cannot function well in such a sudden crisis environment, the situation is made more problematic by the physical conditions that occur during a building fire. Very often smoke from burning carpets and furniture is so dense and noxious that common visual landmarks become obscured, and individuals become disoriented and panicked. In these circumstances many individuals may not find the best path to the nearest exit door or window, even in surroundings that are otherwise familiar. It is known that most fire victims succumb to smoke, not to the heat of the fire.

There are devices known in the prior art that are intended to direct occupants in the event of an emergency such as a fire. Alarm systems in commercial and industrial buildings provide illuminated exit signs to indicate all designated exit doors, and the signs are typically connected to auxiliary power to continue operation in the event of main circuit power failure. Most municipal codes require that such signs be mounted above the door or window. However, most smoky fires proceed by first building up a smoke layer adjacent to the ceiling of a room or hall, and that smoke layer grows rapidly by expanding downwardly from the ceiling. The diffuse light of an exit sign is easily scattered or absorbed by the smoke. Thus heavy smoke may obscure the typical exit sign at a fairly early stage in the development of a blaze, even while survivors may move about close to the floor and seek escape.

Another apparatus in the prior art, described in U.S. Pat. No. 5,572,183, employs a rotating mirror to direct indicator light to a plurality of fiberoptic light guides that extend to sequentially spaced points along a ceiling of a room or hall. Each fiberoptic guide projects a path indicating image, and the rotating mirror causes a plurality of indicator images to be projected sequentially in a spaced apart, progressive manner along the floor of a room or hall. This same technique is taught using a plurality of laser diodes, each installed at one of the sequentially spaced points, and each projecting a path indicating image. These installations require extensive wiring or fiberoptic installation, as well as persistent maintenance to assure operability and alignment of all the high precision components of the system, and cannot be considered practical in commercial or mechanical terms.

Thus, although it is known to project a path indicating image using a laser diode as a light source, and that this light source is superior in penetrating the smoke accumulation that accompanies fire, there is no practical system for taking advantage of this attribute.

There are also known in the prior art alarm systems that provide secondary alarm indications in response to the audible signal of a primary alarm, such as a smoke detector. U.S. Pat. No. 5,177,461 describes an apparatus for attracting fire fighters and rescuers to the exterior of a building in which a smoke alarm has been triggered. However, there is no suggestion in the prior art of the provision of an alarm system that utilizes the audible alert of a smoke alarm as a trigger to actuate an escape path indicating system for the occupants of the burning building.

Moreover, it has been observed that the audible alarm signal of a smoke alarm or the like may form standing waves in a room or hall, particularly in the confined spaces of a typical alarm device mounting position, such as a wall corner or ceiling corner. A standing wave causes zones of compression and rarefaction to stagnate in stable positions. These zones are alternately spaced on a scale that approximates one-half wavelength of the alarm tone. Given an alarm tone in the range of 2.5 KHz, the half-wavelength distance is approximately 2.5 inches (6.25 cm). A typical prior art secondary alarm system, such as the patented one referenced above, uses a single microphone to detect the primary audible alarm. It is clear that a small change in the mounting position of the device can substantially affect the reception of the primary alarm audible signal, and that the standing wave problem may significantly impact the installation of the prior art device.

Even if a secondary alarm system is properly placed, it must continually pick up ambient sound and noise and constantly evaluate this signal for the presence of the primary alarm audible signal. Operating an acoustic pickup (microphone) and processing the signal for detection purposes generally requires the use of several active systems that ceaselessly draw electrical power. As a result, power requirements for these devices demand either large and heavy batteries, or frequent replacement of smaller batteries. Large and heavy batteries necessitate a housing sufficiently large to support them, resulting in a device that is cumbersome and too weighty for safe mounting on a ceiling or wall. On the other hand, the need to replace smaller batteries more frequently creates a high maintenance demand that many homeowners are not well-disposed to meet. Neither option is attractive for a successful product design.

SUMMARY OF THE INVENTION

The present invention generally comprises an apparatus for projecting beams or images along an escape path to direct persons within a building to evacuate in the event of a fire, thereby increasing the possibility that they may safely leave the premises even in the presence of smoke.

In one aspect, the invention includes a plurality of laser diode image projectors secured within a housing and aimed to project successive images along a predetermined fire escape path. The images may comprise simple arrow indicators, graphic symbols, or alphanumeric indicators (in serial, pneumonic or other order), The laser diodes may be any visible wavelength, such as blue, red, orange or green colors now available. The laser diodes are arranged in a group and aligned so that all laser beams are emitted through the same window in the housing of the apparatus. As a result, heat infiltration into the housing is minimized. The laser diodes may be triggered by an alarm condition, such as direct actuation by a smoke sensor, IR detector, networked smart appliance system connected through building wiring or other localized communications channels, or the like, or secondary actuation in response to the audio alarm signal of a primary fire alarm.

In another aspect, the invention includes a fire escape path indicator apparatus that is triggered by the audible alarm signal of another fire alarm system, such as a smoke alarm, building fire alarm, or the like. The apparatus includes a microphone input that is amplified in a two stage op amp and fed to a microprocessor. The microphone signal is connected to an analog/digital converter input of the microprocessor. The microprocessor includes stored programming to carry out the following functions: first, the microphone signal is digitally filtered to remove low frequency components in the band below the nominal frequency of smoke alarms (as set by national and international standards organizations); then, the filtered signal amplitude is compared to a trigger level, and, if it exceeds that level, the filtered signal is tested to determine if the waveform of an audible alarm signal is present, using a fast Fourier transform (FFT) or the like. If the audible alarm signal is detected for a minimum time period, the microprocessor actuates a fire escape path illuminating module.

In a further aspect, the microphone input of the invention includes a pair of microphones disposed in spaced apart relationship and disposed to detect ambient sound. The spacing of the microphones is approximately equal to one-half wavelength of the audible alarm signal of a smoke alarm to avoid having both microphones disposed in rarefaction zones of an acoustic standing wave of the audible alarm signal. Thus at least one of the microphones is well-disposed to pick up the audible alarm signal.

Another aspect of the invention is the provision of a system for operating the microprocessor in a low power mode, and activating the microprocessor only when the microphone signal exceeds a predetermined level. A logic system is connected to the paired microphones and arranged to sample the output signals of each microphone in an alternating, periodic manner. The sampled signal is fed through a two stage op amp, and fed to a threshold detector. If the sampled signal amplitude exceeds the threshold, the detector then signals the microprocessor to activate and begin processing the microphone signal. The microprocessor also locks the logic system to sustain the connection to the microphone that has provided the signal that has awakened the microprocessor. Thus the microprocessor may remain in low power mode for a large proportion of time, and carry out power consuming processing tasks only when the microphone input necessitates such power use. In a further power saving step, the microphones are comprised of piezoelectric devices that self-generate their signals and require no power drain from a battery. These design innovations permit a small battery to power the system for a prolonged period.

An additional aspect of the invention is the provision of a housing for the system described above, the housing formed of polycarbonate or the like to withstand the heat of a fire for some minimal nominal time. The fire escape trail illuminating system is disposed within the housing to project trail indicating markers through a small window in the housing, so that ambient heat intrusion therethrough is minimized. Furthermore, the housing is mounted at opposed ends in the opposed arms of a C-shaped bracket, so that the housing may rotate (yaw) through a large angle to orient the projection of the fire escape path indicators. In addition, the bracket mounting permits the housing to be tilted (pitched) through an angular range sufficient to point the fire escape path indicators to a desired portion of the floor of an enclosed space.

The housing also includes mountings for a pair of microphones disposed in a spaced apart relationship. Each microphone is positioned within a louvered section of the housing to receive ambient noise while blocking radiant heat input to the housing. A test button is also mounted on the exterior of the housing to enable actuation of the fire escape path indicators for alignment and verification purposes. The test button also serves as a reset button to stop the image projectors when the device has self-triggered and return the device to a quiescent ready status.

DESCRIPTION OF THE PREFERRED EMBODIMENT

Figure 1:
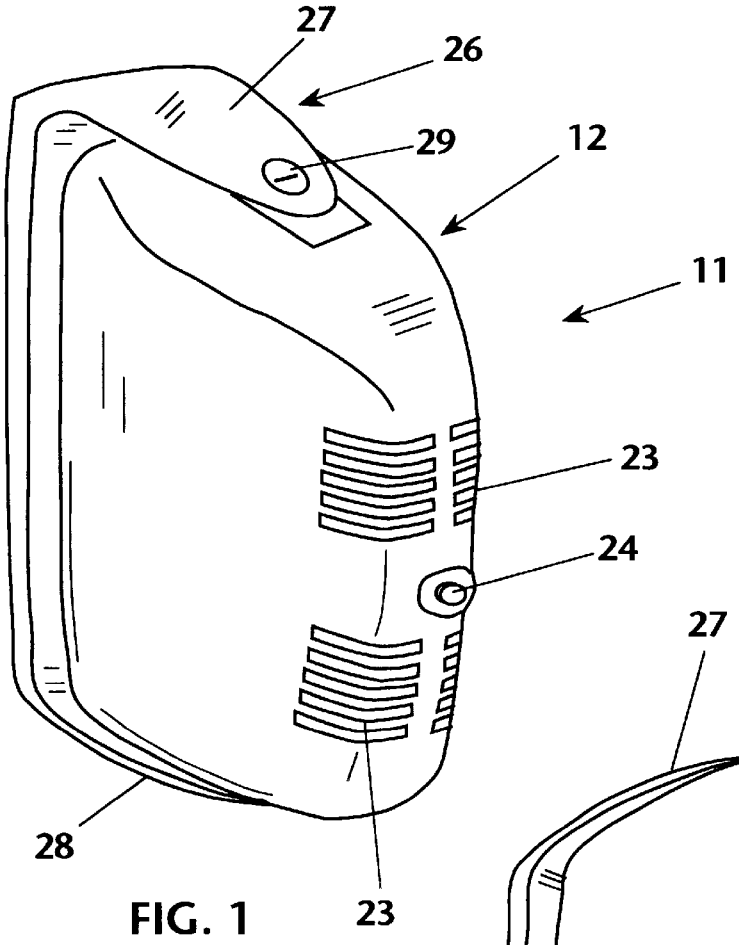
FIG. 1 is a top oblique perspective view of the apparatus of the invention for projecting a fire escape trail indication to mark the path toward a fire exit.
Figure 2:
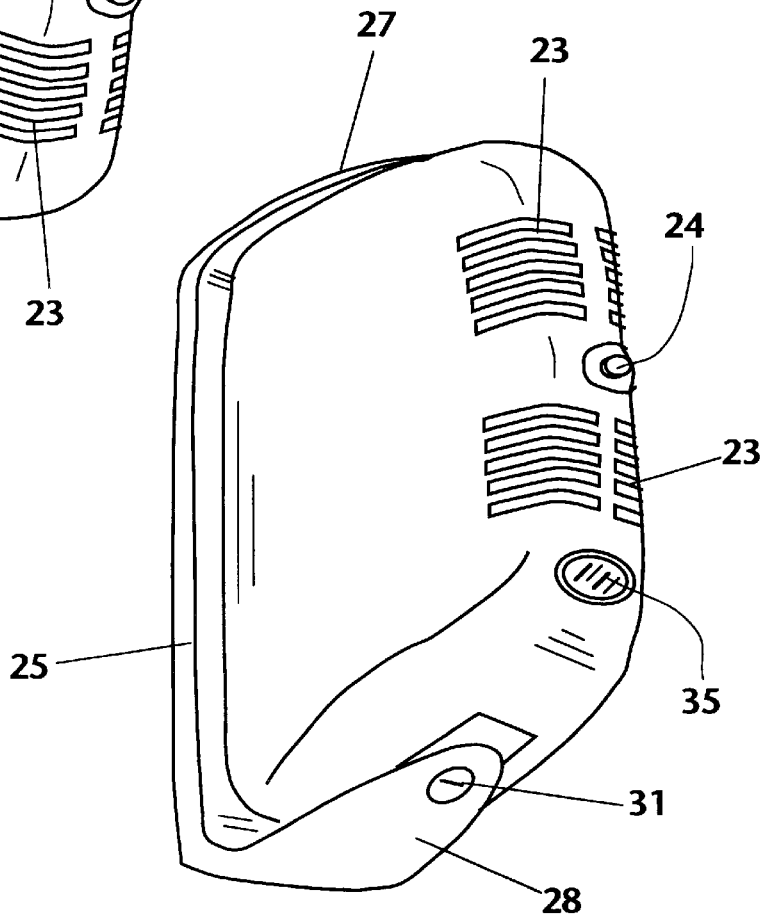
FIG. 2 is a bottom oblique perspective view of the apparatus of the invention for projecting a fire escape trail indication, as shown in FIG. 1.
Figure 3:
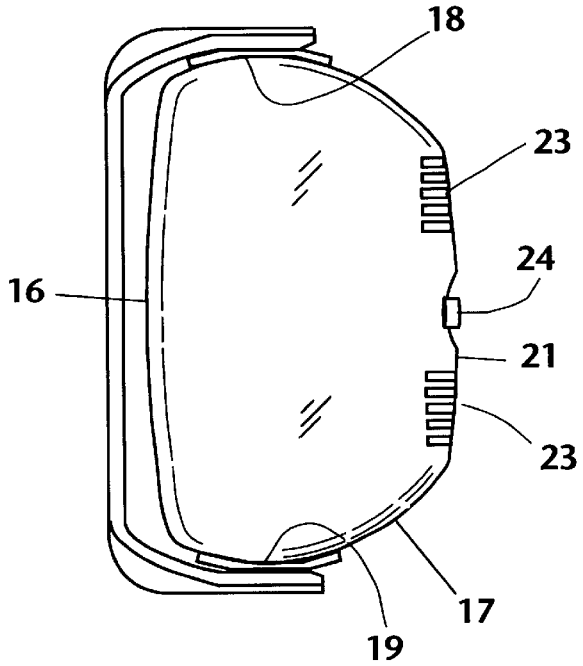
FIG. 3 is a side elevation of the apparatus for projecting a fire escape trail indication, shown in FIGS. 1 and 2.
Figure 5:
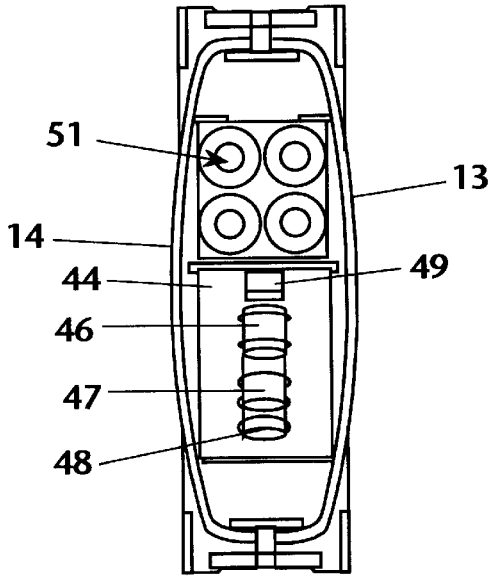
FIG. 5 is a cross-sectional end elevation of the apparatus of FIGS. 1–4, taken along line 5—5 of FIG. 4.

The present invention generally comprises an apparatus for projecting illuminated indicators along a fire escape path to direct persons within a burning building to evacuate safely. With regard to FIGS. 1 and 2, the apparatus 11 includes a housing 12 formed with comprises of a pair of shell members 13 and 14 (FIG. 5) formed in generally enantiomorphic relationship and joined in clamshell fashion. The housing 12 includes an upstanding back panel 16 extending contiguously with a generally planar surface 17 that is curved to wrap around and define the upper and lower ends 18 and 19, respectively, and the front panel 21. Formed in the front panel 21 are a plurality of parallel slots defining a pair of grill portions 23 that open generally toward the front of the apparatus. A test button 24 extends from a medial portion of the front panel, for purposes described below.

Figure 12:
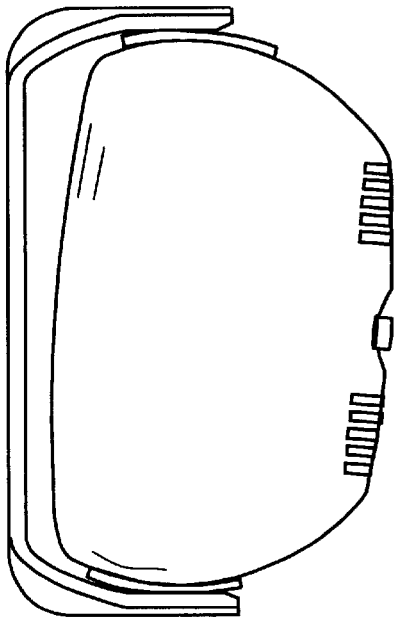
FIG. 12 is a cross-sectional side view of the apparatus, showing the housing tilted in pitch rotation to alter the directions of the fire escape path direction indicators.
Figure 7A:
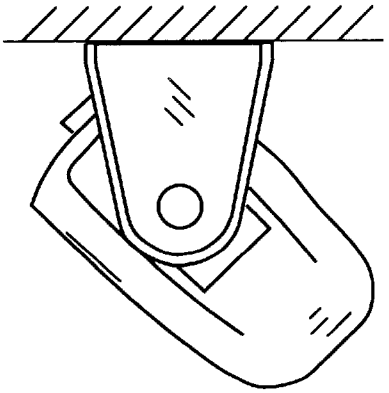
FIGS. 7A and 7B are top views of the apparatus of the invention, showing various angular relationships of the support bracket and housing.
Figure 7B:
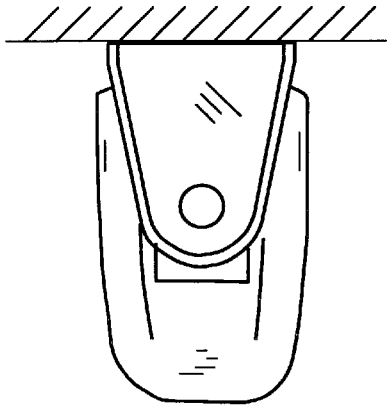

The apparatus 11 further includes a support bracket 26 adapted to support the housing 12 from a structural building surface such as a wall, ceiling, column, or the like. The bracket 26 includes a base panel 25 and upper and lower arms 27 and 28 extending outwardly from opposed ends of the base panel in generally orthogonal relationship. The base panel may be secured to a structural surface using screws or other common fasteners. A pair of mounting pins 29 and 31 extend from the upper and lower arms 27 and 28, respectively, and are received in the housing 12. The pins 29 and 31 are disposed in general axial alignment, whereby the housing 12 may be rotated about the common axis to permit adjustment of the yaw angle of the housing 12 with respect to the base panel 25 and the structural surface to which the base panel is secured, as shown in FIGS. 7A and 7B. In addition, the upper pin 29 extends through a slot 32 formed in the upper end 18 of the housing. The pin 29 is slidable in the slot 32 to permit the housing to be tilted to adjust the pitch angle of the housing with respect to the base panel 25 and the supporting structural surface, as shown in FIG. 12.

Figure 9:
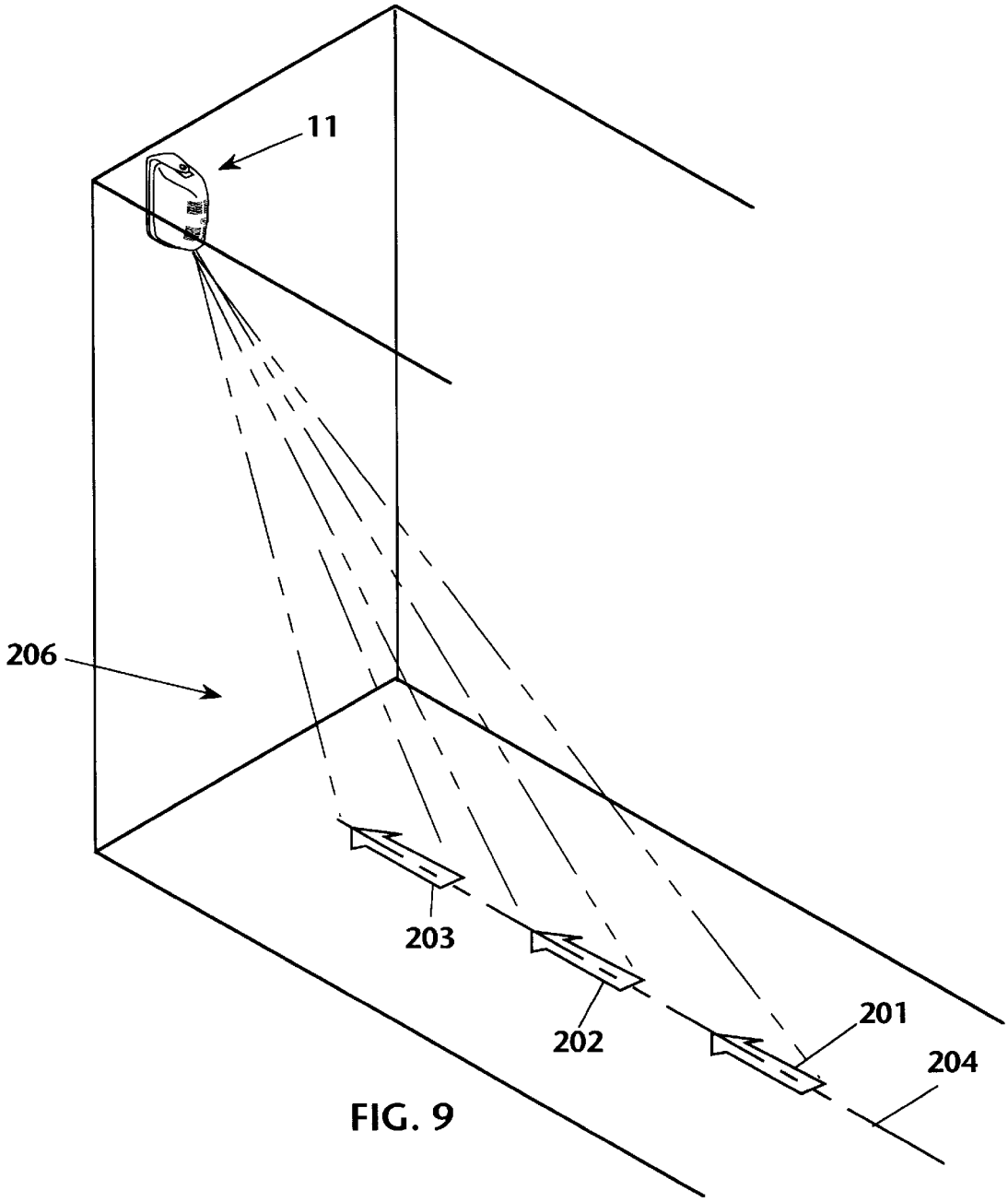
FIG. 9 is a three-dimensional representation of a fire escape path direction indication projected by the apparatus of the invention.

The housing 12 is also provided with a window 35 formed of glass or heatresistant transparent polymer or plastic material. The window is disposed in the lower end panel 19 adjacent to the front portion 21, and is disposed to function as an aperture through which at least one, and preferably a plurality of light images are projected toward a structural surface, such as the floor or ground, as depicted in FIG. 9. The housing 12 and support bracket 26 are formed of a heat-resistant material, such as formed sheet metal, polymer, plastic, fiber-reinforced resin, or the like. The material, such as polycarbonate, is chosen to maintain structural integrity while maximally enduring adverse ambient conditions created by a building fire, such as high temperature, smoke, and water from sprinkler systems and firefighting efforts.

Figure 4:
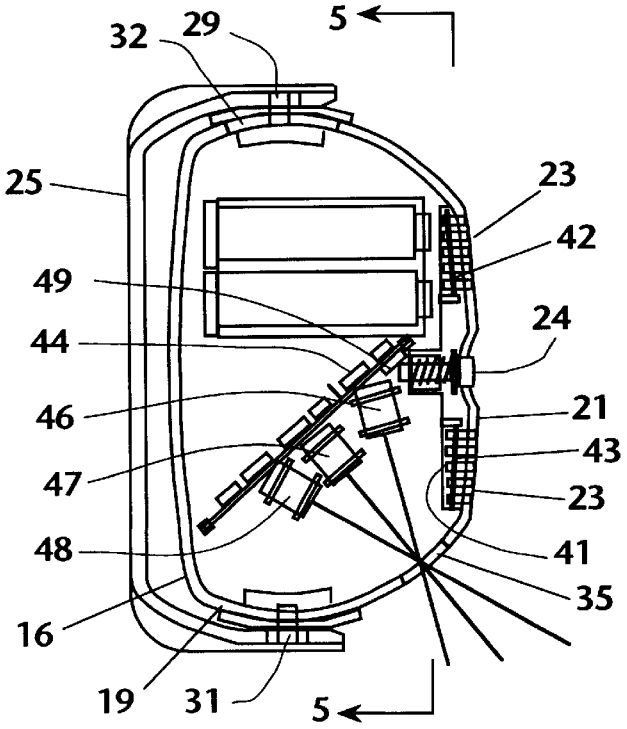
FIG. 4 is a cutaway side elevation of the apparatus for projecting a fire escape trail indication, as shown in FIGS. 1–3.
Figure 6:
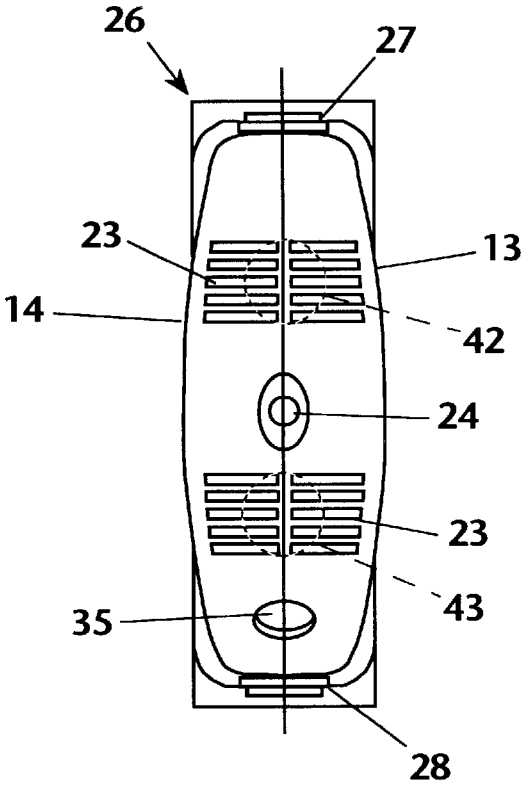
FIG. 6 is an end elevation of the apparatus of FIGS. 1–5.

The housing 12 encloses and supports the active system components of the device. With regard to FIGS. 4 and 5, a backing plate 41 is disposed within the housing and spaced apart from the front panel portion 21. The plate 41 extends behind the grill portions 23, and effectively separates the interior of the housing 12 from the openings of the grill portions 23. Thus the infiltration of heated air from a fire into the housing is blocked by the plate 41. In addition, the plate 41 supports the pushbutton 24 in a receptacle integrally formed therein.

Supported between the backing plate 41 and the grill portions 23 are a pair of microphones 42 and 43, both directed to pick up ambient sounds passing through the grill portions 23. The spacing between the microphones 42 and 43 is approximately 2.5–3.0 inches, which is approximately the half-wavelength distance for a standard fire alarm warning tone in the range of 2.5 KHz. This spacing enables at least one of the microphones to be disposed to receive the fire alarm audible warning tone, even in situations where standing waves formed by the warning tone causes zones of compression and rarefaction to stagnate in stable positions near the housing 12. The microphone spacing may be selected in accordance with the wavelength of any expected fire alarm warning tone.

Also supported within the housing 12 is a printed circuit board 44, extending obliquely between the inner extent of the pushbutton 24 and a location adjacent the conjunction of the back panel 16 and lower end panel 19. The board 44 provides all the electronic components for carrying out the functions of the device, generally supported on one side of the board. In addition, a plurality of laser diode projectors 46, 47, and 48 are supported on the other side of the board 44 and connected to the electronic circuitry of the board. The laser diode projectors 46–48 are directed to emit focused beams or images through the window 35, the beams or images being designed to direct a fire victim toward a planned exit, as explained in more detail in the following description. Although three projectors are shown, the actual number may be greater or less than three.

The laser diode projectors 46–48 may make use of any laser diodes that emit light in the visible spectrum, including red, green, orange or blue laser diodes, or any combination of such diodes. The output power may be in the range of 0.1 mW–100 mW, depending on physical variables and regulatory limitations. The image content of each projector may be provided by a transmission hologram, and conventional optics collimates and directs the beam to a structural surface.

Also supported on the lower side of the board 44 is a microswitch 49 which is actuated by the inner end of the plunger of the pushbutton 24. The housing 12 also contains a battery 51, comprised of a quartet of AA cells or the like. The battery 51 provides electrical power for the electronic circuitry and the laser diode projectors.

Figure 8:
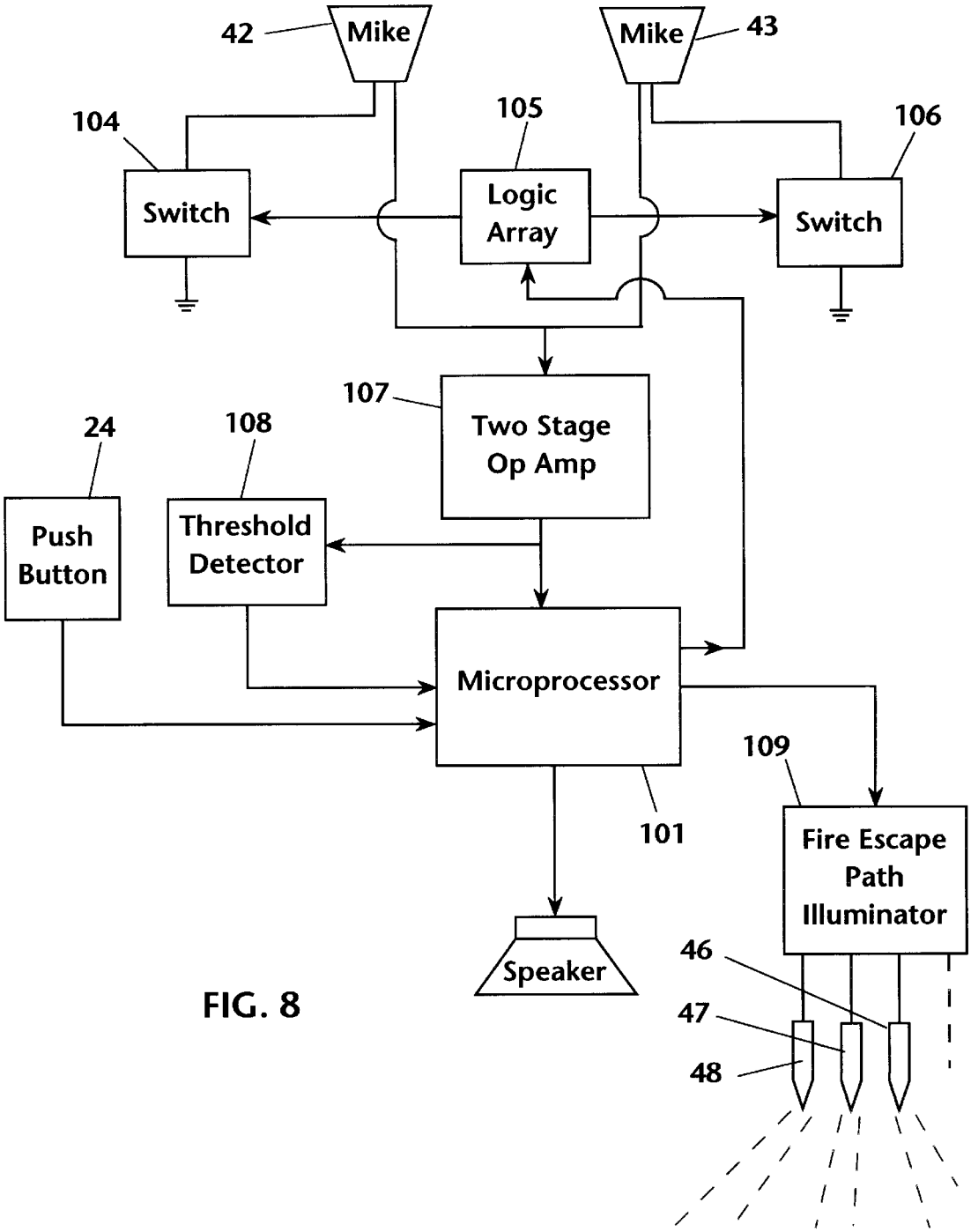
FIG. 8 is a functional block diagram of the electronic circuit of the apparatus of the invention.

With regard to FIG. 8, the electronic system of the invention includes a microprocessor 101 that has analog/digital input ports, a trigger input port, and analog and digital output ports. The microprocessor 101 also includes sufficient ROM or other memory to store instructions and values required to carry out the functional steps described below.

In general, the microprocessor 101 is set up to detect the audible alarm signal of a smoke alarm or similar alarm system that senses the presence of fire and warns occupants of a building. The electronic system includes the pair of microphones 42 and 43 having outputs connected together and fed through a two stage op amp assembly 107 to an ADC input of the microprocessor 101. The ground connectors of each microphone are connected to electronic switches 104 and 106, respectively, the switches being controlled by a logic array 105. The logic array in turn is connected to an output port of the microprocessor 101.

In addition, the output of the two stage op amp assembly 107 is fed to a threshold detector 108, which sets a minimum amplitude level for the amplified microphone signal. The output of the detector 108 is connected to a trigger port of the microprocessor, whereby actuation of the detector 108 by a microphone signal greater than the threshold level will cause the detector to pull the microprocessor port low and activate the microprocessor to begin to execute its programming.

Also, the logic array 105 is set up so that in the absence of a signal from the microprocessor 101, the switches 104 and 106 are triggered alternately and periodically to sample the signals from each microphone 42 and 43 regularly and frequently. If the signal from the op amp assembly 107 does not exceed the threshold of detector 108, the microprocessor 101 remains in low power mode. If the op amp signal is sufficient to trigger the detector 108, it activates the microprocessor to power up and begin processing the microphone signal. As an initial step, the microprocessor also signals the logic array 105 to maintain actuation of the switch 104 or 106 that has enabled the microphone signal sufficient to trip the threshold detector.

The microphones 42 and 43 are piezoelectric devices that generate a voltage in proportion to the acoustic energy impinging thereon. The microphones do not require any electrical power for their function, and are selected in size and resonance to be inherently tuned to the bandwidth that contains the audible signal of a primary fire alarm. Therefore the audio detection function of the circuit draws minimal battery power. Likewise, the combination of the threshold detector 108 and the logic array 105 serve to maintain the microprocessor 101 in low power, or sleep, mode through a great majority of time. Thus a significant aspect of the electronic circuit is that it is capable of sensing and detecting the audible alarm signal of a primary fire alarm while preserving the stored energy of the battery 51. As a result, the device provides a battery life of approximately one year or more, obviating the high maintenance requirements of comparable prior art devices.

The microprocessor 101 is a programmable device that executes a program (lists of encoded instructions) stored in a non-volatile memory. The instructions are written to provide a series of functional steps, as described below, that carry out the necessary tasks to achieve the system operation described herein.

Figure 13:
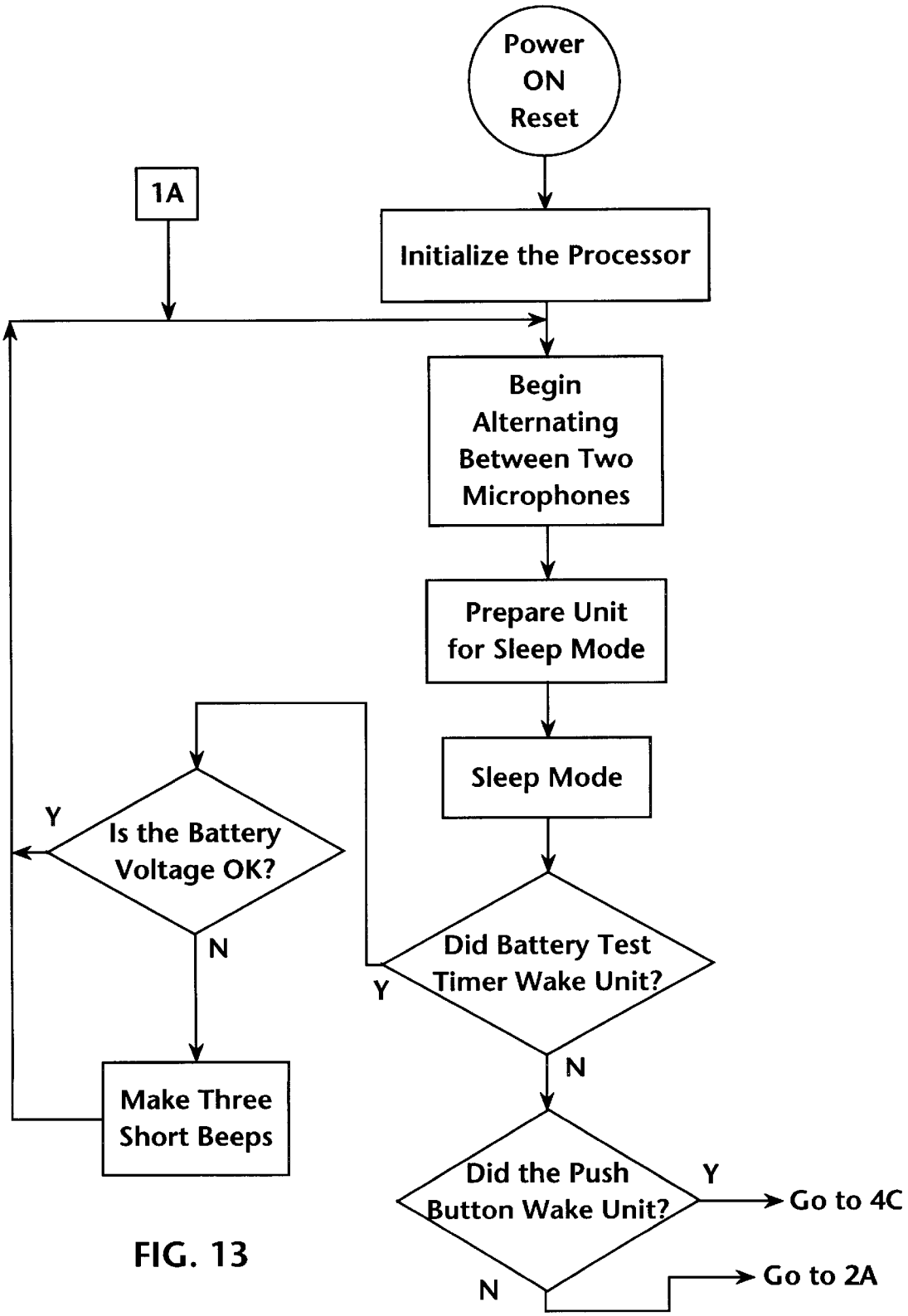
FIGS. 13–17 are connected portions of a function flow chart depicting the algorithm that operates the microprocessor of the apparatus.

With reference to FIG. 13, the program begins with an initial Power ON or Reset input. The microprocessor is initialized, as by loading the program or determining that the program is already loaded in memory.

The microphone signal is processed by first converting the analog signal to digital values, and then operating on those digital values according to the stored programming. Thereafter, the system begins alternating between the microphones 42 and 43 by actuating the logic array 105 to alternately activate the switches 104 and 106. The logic array continues to periodically change the microphone signal that is input to the microprocessor without further signal from the microprocessor. The microprocessor is then prepared for sleep mode and is placed in sleep mode, during which computational tasks are minimized to conserve electrical power consumed from the battery 51.

The microprocessor 101 remains sensitive to various signals at designated I/O ports. Upon receiving such a signal the software first checks to determine if the battery test timer initiated the wake-up signal. (A battery voltage test routine is initiated after a preset number of minutes of operation of the unit; e.g., every 10–1000 minutes.) If the wake-up signal was from the battery test timer, the battery voltage is assessed. If the voltage is outside a predefined nominal range, the system actuates a transducer to emit three short beeps. Whether or not the voltage is good, the program then loops back to the point just after initialization of the microprocessor.

If the wake-up signal is not from the battery test timer, the program then assesses if the wake-up signal was sent from the manual push button 24. If yes, the program goes to point 4C (FIG. 16) to initiate a brief laser indicator output flash, as will be described below. If the wake-up signal is not from the push button 24, the only possible remaining wake-up signal must come from the threshold detector 108, indicating that one of the microphones has picked up a sound of sufficient amplitude to overcome the preset threshold. Therefore, the program shifts to point 2A and begins a routine to analyze the microphone signal, as shown in FIG. 14.

Figure 14:
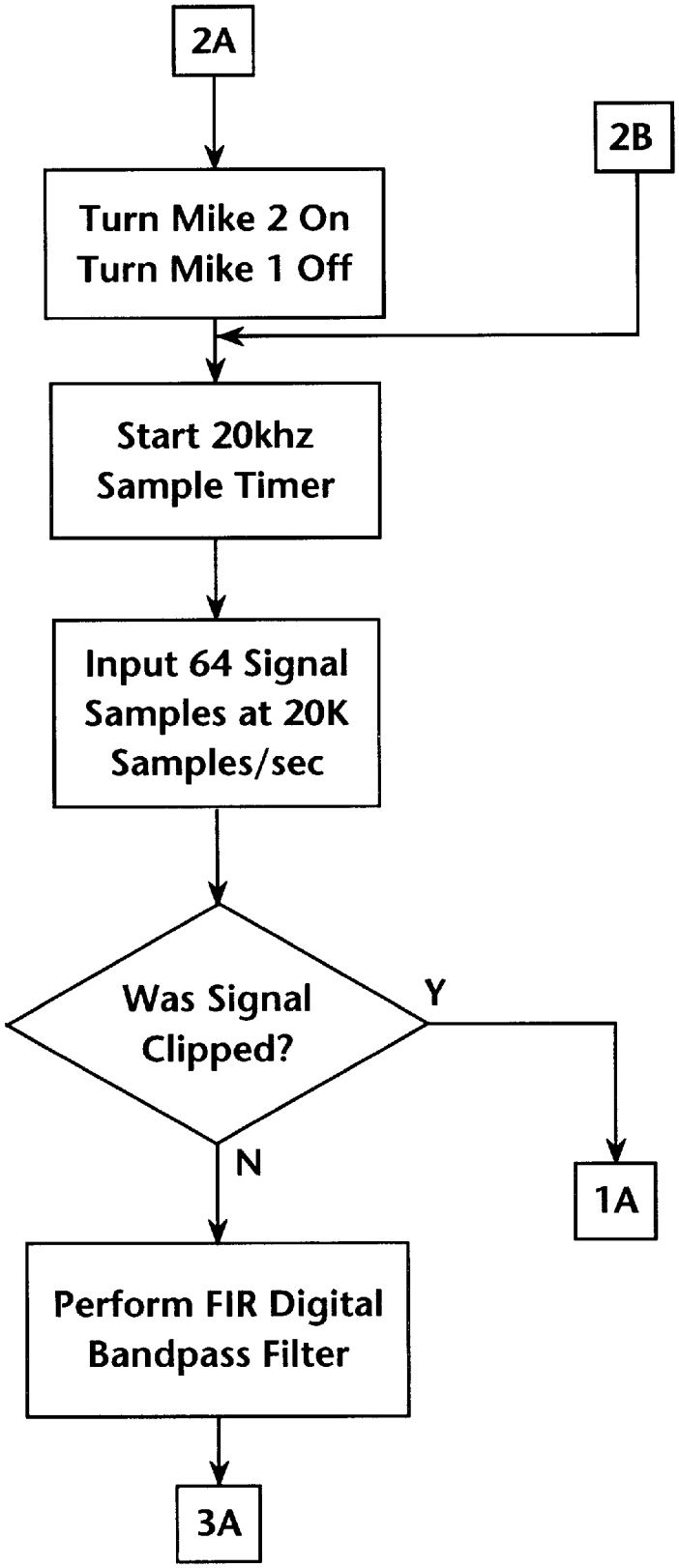

With reference to FIG. 14, the first step of the signal analysis is that microphone 2 is turned ON and microphone 1 is turned OFF. A 20 KHz sample timer is initiated, and the microprocessor then takes 64 consecutive samples at the 20 KHz rate. If the signal samples are clipped, as from a loud, brief sound (sonic boom door slam, etc.),the program returns to point 1A (FIG. 13), so that the program will reiterate the steps leading to 2A only if the microphone signal continues. If the signal is not clipped, the microprocessor performs a FIR digital bandpass filter routine to remove all frequencies except those within a narrow passband;i.e., the band in which primary fire alarms (smoke alarms, etc.) emit audio warning signals. Regulations and product safety codes have created a defined passband that contains most of these audio warning signals.

Figure 15:
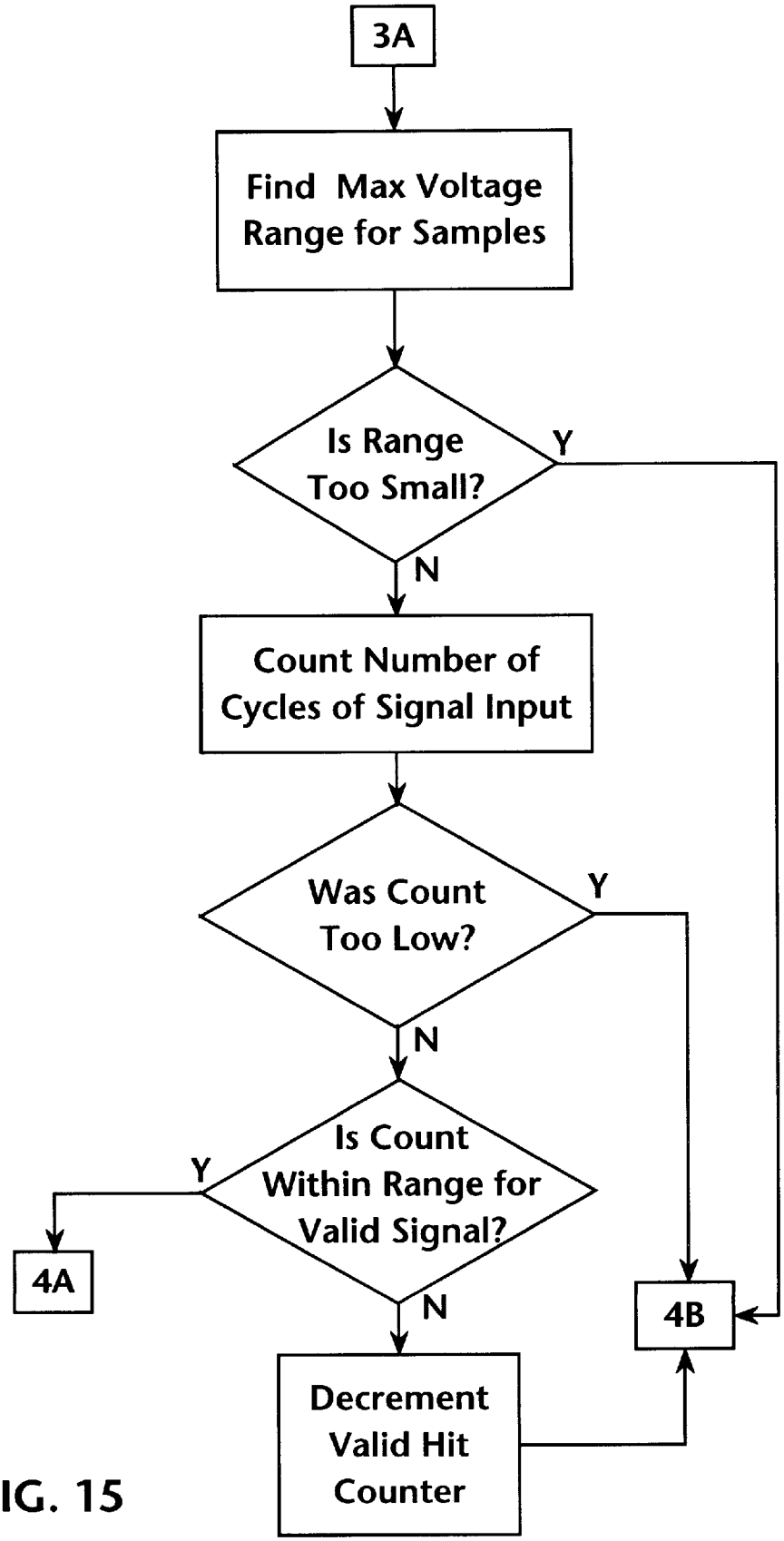

The program then moves to point 3A, FIG. 15, and finds the maximum voltage range for the samples. If the voltage range is too small, indicative of an audio input with insufficient amplitude, the program routes to point 4B, FIG. 16, to switch microphones and check the signal from the other microphone, as will be detailed in the following description. If the voltage range is sufficient, the program next counts the number of cycles of the sound input. The cycles must have a minimum peak-to-peak change, indicative of an audio input having a generally constant amplitude. If the count is too low, the program routes to point 4B, FIG. 16, to switch microphones and check the signal from the other microphone. The program then determines if the count is within range to be a valid signal. If yes, the program goes to point 4A, FIG. 16, and increments the hits counter, as explained below. If the count is outside the range of validity, the valid hit counter is decremented, and the system goes to point 4B, FIG. 16, to change microphones.

Figure 16:
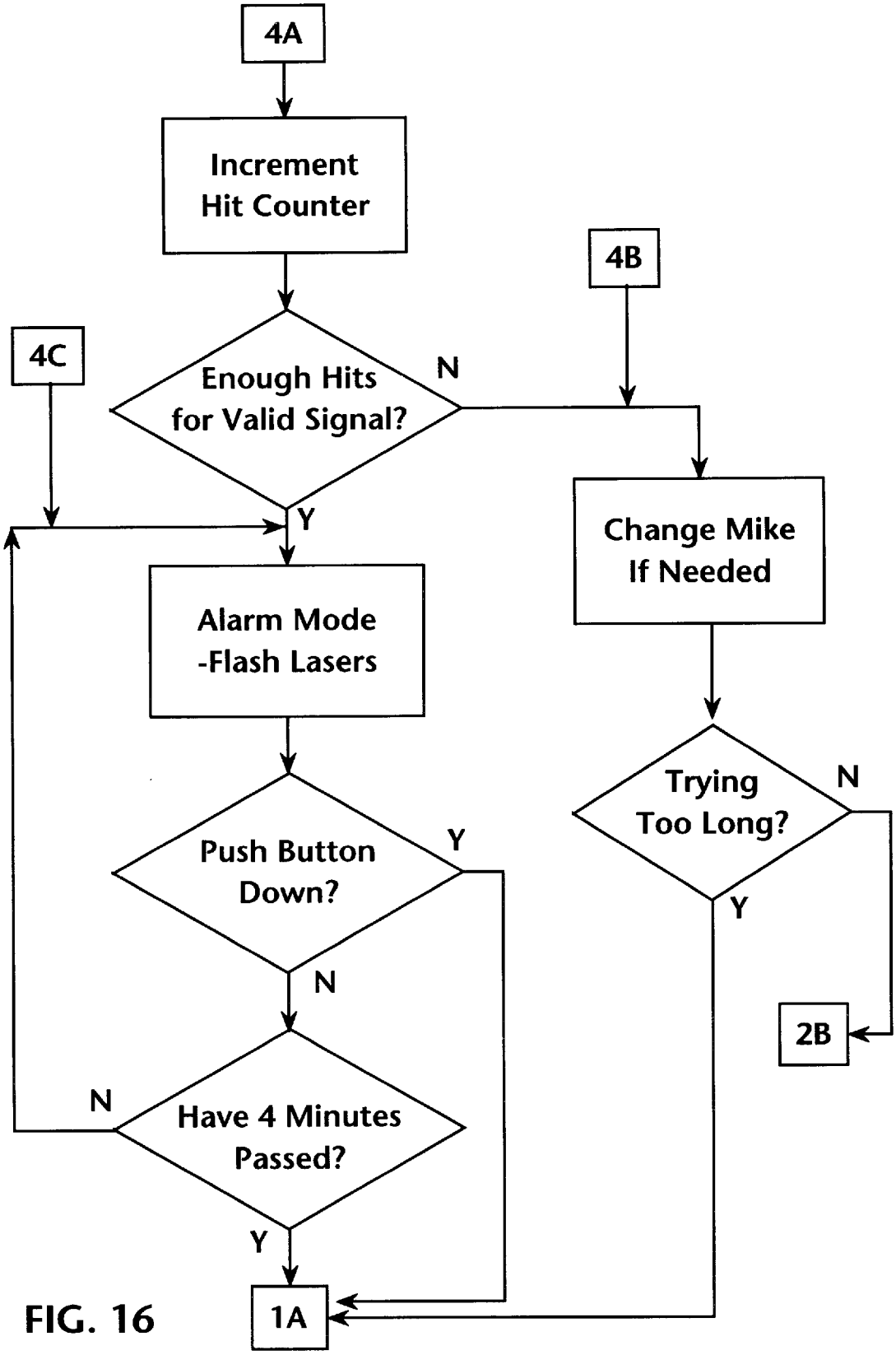

Thus, with reference to FIG. 16, the program routes to point 4A to increment the hit counter only when the following actions have occurred: the processor wakes up, determines that the wake-up was caused by a signal passing the threshold detector; the signal is sampled, and the sample is checked to determine if it was clipped; the sample is digitally filtered to remove all frequencies outside an alarm signal passband; the sample is checked for amplitude, constant amplitude, and frequency; if the sample passes all these tests, the hit counter is incremented.

The program tracks the contents of the hits counter; if there are sufficient hits for a valid signal, indicative that a minimum number of cycles of a valid alarm warning tone have been received, the program goes to alarm mode and begins to flash the laser diodes 46–48. The program checks to determine if the push button 24 is depressed. If yes, the program returns to point 1A, the beginning of the program, enabling a return to the sleep mode. Thus the push button also serves as a reset button when the alarm is self-triggered. If no, the program counts 4 minutes while the lasers are flashed, and then returns to point 1A, initialization of the program.

Figure 17:
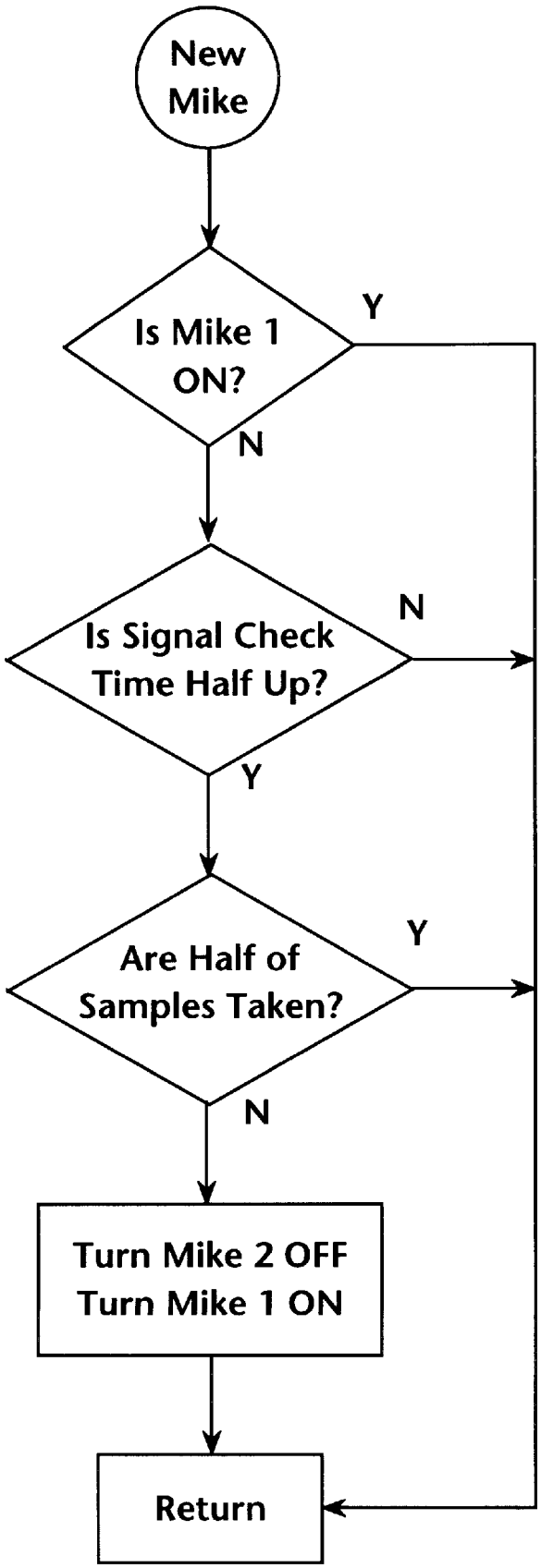

If there are not sufficient hits to confirm a valid signal, the program goes to a change microphone routine. The program then continues to accept signals for approximately 7 seconds, after which it returns to point 1A a the beginning of the program, enabling a return to the sleep mode. With regard to FIG. 17, the change mike routine first determines if microphone 1 is on; if yes, the routine returns to the main program of FIG. 16. If not, the program checks to determine if less than half the signal sample time remains; if so, it determines if half of the samples have been taken, and, lacking a sufficient sample number, switches microphone 2 OFF and microphone 1 ON, and returns to the main program. This subroutine, in conjunction with the program step at point 2A, FIG. 14, which requires that microphone 2 is switched ON and microphone 1 is switched OFF, assures that the microphone signals are alternated whenever an incoming signal that passes the threshold fails to qualify as a valid signal.

Upon a confirmed indication that the audio alarm signal of a primary fire alarm system has been received, the microprocessor 101 delivers an actuation signal to a fire escape path illuminator 109. Although the program flow chart makes reference to laser diodes only, the device 109 may comprise any path illuminating device or devices, including lamps, LEDs, laser diodes, or the like. In correspondence with the previous description of the housing 12 and the components supported therein, the device 109 may comprise the driver circuitry for the laser diode projectors 46, 47, and 48. The devices 46–48 are actuated to flash in a predetermined order sequentially and serially, projecting path indicating images on adjacent floor or wall surfaces to lead a fire victim toward a designated exit door or window. The images are flashed in a sequence so that the images proceed along the path toward the exit, and, in addition, each image is pointed or otherwise aligned toward the exit.

With regard to FIG. 9, the device 11 may be secured by support bracket 26 to a wall surface adjacent to its junction with the ceiling of a room or hallway 206. The device 11 is adjusted in yaw and pitch angles so that it projects a plurality of arrow indicators 201, 202, and 203 sequentially along a path 204 which is a designated escape path leading toward an exit of the room or hallway 206. The arrows point in the escape direction, and the sequential illumination of the arrows in their numerical order also serves to lead a fire victim toward the exit.

Figure 10:
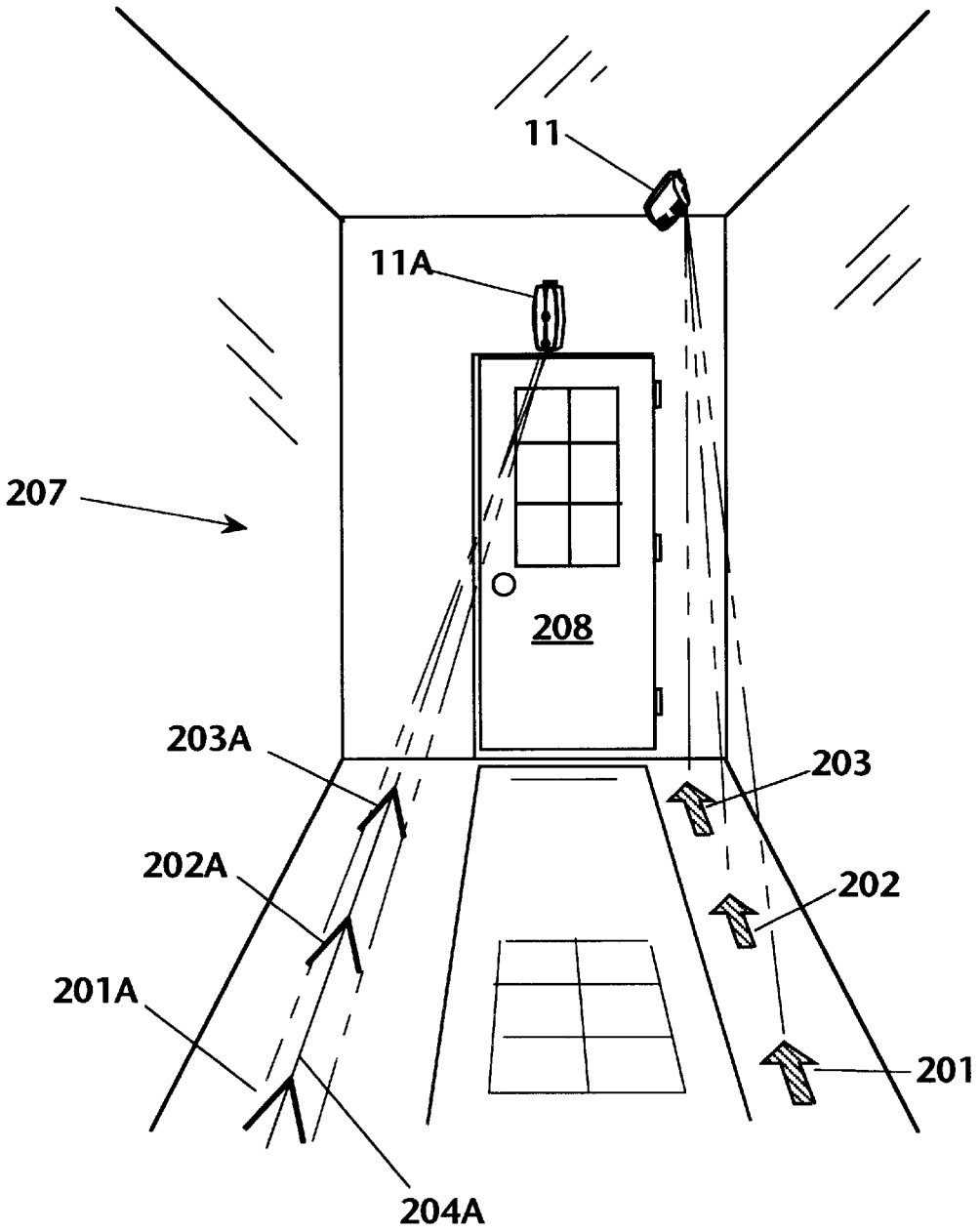
FIG. 10 is another perspective representation of examples of fire escape path direction indications projected by the apparatus of the invention.

As another example, with regard to FIG. 10, a device 11 may be mounted on a ceiling surface of a room or hallway 207, and the arrow indicators 201–203 may be directed to illuminate sequentially toward an exit door 208. Likewise, a device 11A may be wall-mounted above the exit door 208, and directed to project chevron images 201A–203A along a path 204A leading toward the exit 208. Thus any image may be used that conveys the notion of movement in a desired direction. Furthermore, a plurality of devices 11 (or 11A) may be employed within the same building space, the only limitation being proximity to a primary fire alarm annunciator.

Figure 11:
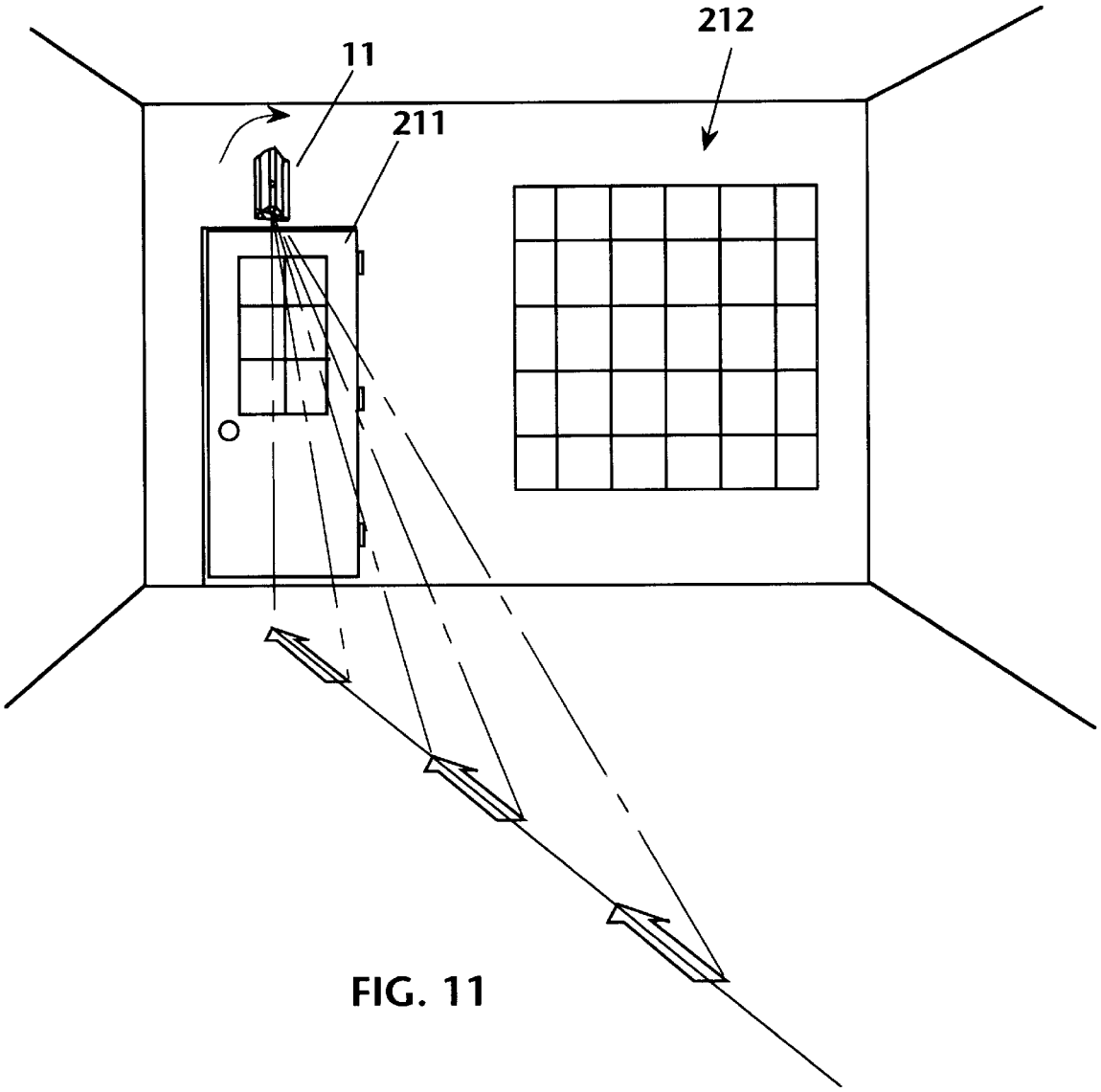
FIG. 11 is a further perspective representation of an example of a fire escape path direction indication projected by the apparatus of the invention.

A further example, shown in FIG. 11, shows a device 11 wall-mounted above a door 211 of a room 212. The device 11 is adjusted angularly so that the arrow indicators projected from the device 11 define a path extending obliquely across the floor of the room toward the door 211. Thus the path indicators need not be aligned in a path that parallels a structural surface of the building. It may be appreciated that as a building fire progresses, smoke rise and accumulates adjacent to the ceiling. Even though the smoke will diminish visual recognition of the images being projected, the light rays penetrating the smoke act as an effective directional indicator. And, as the smoke thickens and the laser beams become more scattered, the resulting flashing luminous glow around the device 11 further acts as a beacon to guide fire victims toward an exit.

It may be appreciated that aspects of the invention, such as the angularly adjustable housing and mounting, and the laser diode projectors supported therein, may be combined with another primary alarm actuator, thereby obviating the need for an audio pickup system and signal processing to detect the audible alarm signal of a distant fire alarm. Likewise, other path indicating image projecting means, such as high power LEDs of various colors, lamps, or flashlamp devices may be used in place of the laser diodes described herein. Although these devices may not be equivalent in penetrating smoke from fires, they may make use of more conventional image forming and projection optics, such as masks, lenses and reflective surfaces.

Likewise, the battery 51 may be eliminated or augmented with the addition of a power supply that is plugged into a standard power receptacle and connected by wire to the device 11. In this alternative, an alarm activating signal may be transmitted through the building power wiring from the primary alarm system to the device 11, and the need is eliminated for audio pickup and processing to detect an audio alarm signal.

Figure 18:
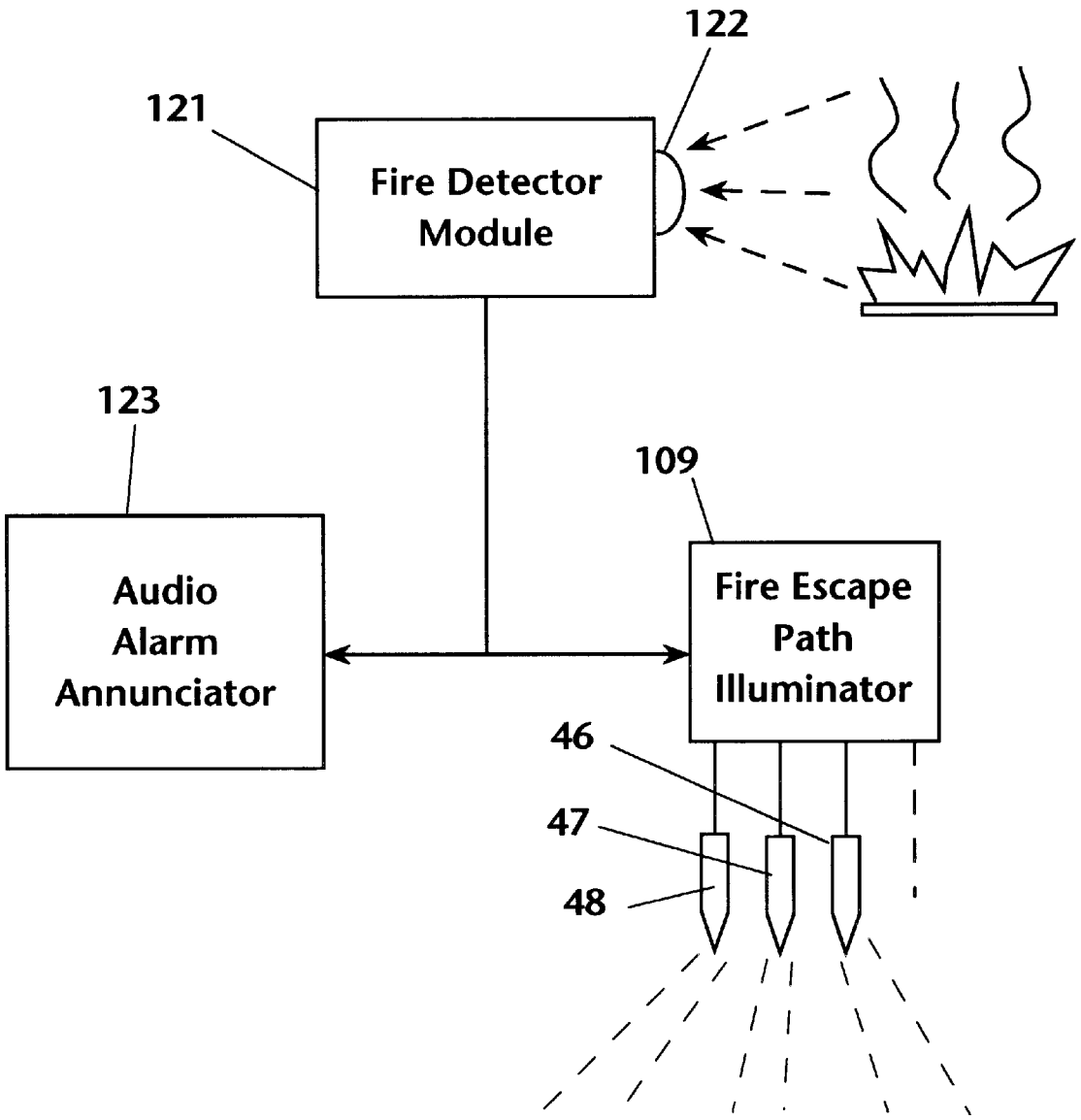
FIG. 18 is a functional block diagram of a further embodiment of the fire escape path indicator of the invention.

With regard to FIG. 18, it is also within the scope of the invention to combine the fire escape path illuminator 109 described previously with a fire detector module 121. The module 121 includes an alarm sensor 122 comprised of one which senses the presence of ambient smoke using ionization detection, light scattering detection, etc., as known in the prior art. Likewise, the sensor 122 may comprise an infrared sensor that directly detects the radiated IR indicative of a fire. In this embodiment the smoke detector module directly actuates the device 109, without recourse to the microphones, circuitry, and programming described reviously that is necessary to detect the audio alarm signal of a primary fire alarm. In addition, the module may also actuate an audio alarm annunciator 123, as is also known in the prior art. Alternatively, the fire escape path illuminator 109 may be triggered by a networked system of smart appliances that communicates through building wiring or other localized communications channels.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. A device for directing evacuation during a fire by illuminating a fire escape path, including:

means for sensing an alarm condition indicative of a fire emergency and generating an alarm actuating signal;

means for responding to said alarm actuating signal by projecting at least one evacuation path indicator along said fire escape path;

said means for sensing an alarm condition including a primary fire alarm system extrinsic to said device and adapted to generate an audio alarm signal in response to a fire;

further including means for detecting said audio alarm signal and generating said alarm actuating signal in response thereto;

said means for detecting said audio alarm signal including audio pickup means for receiving ambient sound and generating an ambient sound signal, and means for detecting a valid audio alarm signal in said ambient sound signal;

said audio pickup means including a pair of microphones, and switching means for selecting the strongest ambient sound signal from said pair of microphones.

2. A device for directing evacuation during a fire by illuminating a fire escape path, including:

means for sensing an alarm condition indicative of a fire emergency and generating an alarm actuating signal;

means for responding to said alarm actuating signal by projecting at least one evacuation path indicator along said fire escape path;

a housing enclosing said means for sensing and means for responding, said housing having a generally closed curved shape defining an enclosed interior space; and, a pair of microphone receptacles formed in said housing and separate from said enclosed interior space, said microphone receptacles having openings to receive ambient sound.

3. The device of claim 2, wherein said means for sensing an alarm condition includes a primary fire alarm system extrinsic to said device and adapted to generate an audio alarm signal in response to a fire;

said audio alarm signal having a nominal wavelength, and said microphone receptacles being spaced apart approximately one-half of said nominal wavelength.

4. The device of claim 2, wherein said microphone openings include exterior grill portions in said housing.

5. The device of claim 2, further including a test pushbutton secured to said housing and extending partially therefrom, said pushbutton being disposed medially of said pair of microphones.

6. A method for directing occupants of a burning building to a designated exit, including the steps of:

providing a path indicating device mounted on an upper structural surface in the building;

detecting an alarm condition caused by a building fire;

actuating a light projection module in said path indicating device to project at least one escape path indicator;

said detecting step including the step of monitoring ambient sound and detecting the audio alarm signal of a primary fire alarm;

said detecting step including providing a pair of microphones, and alternatively monitoring signals from the pair of microphones to detect the audio alarm signal.

7. A device for directing evacuation during a fire by illuminating a fire escape path, including:

means for sensing an alarm condition indicative of a fire emergency and generating an alarm actuating signal;

means for responding to said alarm actuating signal by projecting at least one evacuation path indicator along said fire escape path;

said means for sensing an alarm condition including a primary fire alarm system extrinsic to said device and adapted to generate an audio alarm signal in response to a fire;

means for detecting said audio alarm signal and generating said alarm actuating signal in response thereto, said means for detecting said audio alarm signal including a pair of microphones.

8. The device of claim 7, wherein said microphones are spaced apart a distance approximately equal to one-half wavelength of said audio alarm signal, whereby standing wave effects are neutralized.

9. The device of claim 7, wherein said means for detecting said audio alarm signal and generating said alarm actuating signal includes a microprocessor having programming means for carrying out a series of actions in an ordered manner.

10. The device of claim 9, wherein said programming means includes the step of switching between the signals of said pair of microphones to select the strongest ambient sound signal from said pair of microphones.

11. The device of claim 10, wherein said programming means includes the step of carrying out a digital filtering process to said ambient sound signal to pass only those frequencies within a passband that contains the frequency of said audio alarm signal.

12. The device of claim 11, wherein said programming means includes the step of invalidating the ambient sound signal if the ambient sound signal has been clipped.

13. The device of claim 12, wherein said programming means includes the step of invalidating the ambient sound signal if the amplitude variation of the ambient sound signal is greater than a predetermined value.

14. The device of claim 13, wherein said programming means includes the step of counting the cycles of the ambient sound signal, and invalidating the ambient sound signal if the cycle count is outside a predetermined range.

15. The device of claim 14, wherein said programming means includes a hits counter, and including the step of incrementing the hits counter at each validated instance of detection of an audio alarm signal.

16. The device of claim 15, wherein said programming means includes the step of generating said alarm actuating signal whenever said hits counter exceeds a predetermined value.

17. A device for directing evacuation during a fire by illuminating a fire escape path, including:

means for sensing an alarm condition indicative of a fire emergency and generating an alarm actuating signal;

means for responding to said alarm actuating signal by projecting a plurality of evacuation path indicators along said fire escape path;

wherein said path indicators includes a plurality of light beam projectors disposed within a common housing; and, mounting means for supporting said housing in angularly adjustable fashion to permit simultaneous aiming of said plurality of light beam projectors toward the fire escape path.

18. The device of claim 17, wherein said light beam projectors are flashed alternately and sequentially to indicate a preferred direction of evacuation along said fire escape path.

19. The device of claim 17, further including pushbutton means for generating a brief alarm actuating signal and causing said at least one path indicator to be actuated.

20. A device for directing evacuation during a fire by illuminating a fire escape path, including:

means for sensing an alarm condition indicative of a fire emergency and generating an alarm actuating signal;

means for responding to said alarm actuating signal by projecting a plurality of evacuation path indicators along said fire escape path;

wherein said path indicators includes a plurality of light beam projectors disposed within a common housing; and, an opening in said housing through which said light beam projectors transmit respective light beams in mutually angularly diverging fashion to said fire escape path.

21. The device of claim 20, further including mounting means for supporting said common housing on a wall or ceiling surface, said light beam projectors being directed obliquely downwardly from the mounting means toward a floor surface.

22. The device of claim 21, wherein said mounting means includes means for selectively adjusting the yaw angle of said common housing to aim said plurality of light beam projectors in a horizontal plane.

23. The device of claim 21, wherein said mounting means includes means for selectively adjusting the pitch angle of said common housing to air said plurality of light beam projectors in a vertical plane.

24. The device of claim 20, wherein said opening in said common housing includes a transparent window through which said plurality of light beam projectors are directed, said transparent window blocking infiltration of hot air into said common housing.

25. The device of claim 20, wherein said plurality of light beam projectors includes a plurality of laser diode projection units.

26. The device of claim 25, wherein said light beam projectors including means for projecting indicia denoting said preferred direction of evacuation.

27. The device of claim 20, said common housing enclosing said means for sensing and means for responding, said housing having a generally closed curved shape defining an enclosed interior space.

28. The device of claim 27, wherein said mounting means includes a mounting bracket adapted to be secured to a structural surface, said bracket including spaced apart, opposed arms, said arms including like distal portions dimensioned to secure said housing therebetween in rotatable fashion about a yaw axis.

29. The device of claim 28, further including means interposed between said like distal portions and said housing for selectively rotating said housing about a pitch axis.

30. The device of claim 27, further including a transparent window portion of said housing, said window portion transmitting said at least one evacuation path indicator and blocking intrusion of hot air into said housing.

31. A device for directing evacuation during a fire by illuminating a fire escape path, including:

means for sensing an alarm condition indicative of a fire emergency and generating an alarm actuating signal;

means for responding to said alarm actuating signal by projecting a plurality of evacuation path indicators along said fire escape path;

wherein said path indicators includes a plurality of light beam projectors disposed within a common housing; and, said light beam projectors including means for projecting indicia denoting a preferred direction of evacuation along said fire escape path.

32. A method for directing occupants of a burning building to a designated exit, including the steps of:

providing a path indicating device mounted on an upper structural surface in the building;

detecting an alarm condition caused by a building fire;

actuating a light projection module in said path indicating device to project a plurality of light beams from a plurality of light beam projector within said path indicating device toward an adjacent floor surface;

further including the step of rotating said path indicating device about yaw and pitch axes to aim said light projection module toward a designated escape path.

33. The method of claim 32, further including the step of alternating actuation of said light beams serially and sequentially to indicate a preferred direction along the escape path.

34. The method of claim 32, wherein said detecting step includes the step of monitoring ambient sound and detecting the audio alarm signal of a primary fire alarm.

35. The method of claim 34, wherein said detecting step further includes the step of operating the path indicating device in a low power consuming sleep mode, and waking the device only when ambient sound exceeds a predetermined level.

* * * * *